US005940980A

United States Patent [19]

Lee et al.

[11] Patent Number: 5,940,980

[45] Date of Patent: Aug. 24, 1999

[54] HANDS-FREE HAIR DRYER

[76] Inventors: Anessa E. Lee; Linda M. Lee, both of 4560 Seaboard La., Fort Collins, Colo. 80525

[21] Appl. No.: 09/079,082

[22] Filed: May 14, 1998

Related U.S. Application Data

[60] Provisional application No. 60/048,359, Jun. 2, 1997, and provisional application No. 60/068,429, Dec. 22, 1997.

[51] Int. Cl.[6] ..... A45D 20/14

[52] U.S. Cl. ..... 34/97; 34/90; 34/91; 392/382; 392/383; 248/229.14; 248/231.51

[58] Field of Search ..... 34/90, 91, 96, 34/97, 98, 99; 392/379, 380, 382, 383, 384, 385, 472; 248/229.14, 229.23, 229.24, 231.51

[56] References Cited

U.S. PATENT DOCUMENTS 4,712,313 12/1987 Gettleman ..... 34/97

5,761,825 6/1998 Ammon et al. ..... 34/97

*Primary Examiner*—Henry Bennett

*Assistant Examiner*—Pamela A. Wilson

*Attorney, Agent, or Firm*—Dean P. Edmundson

[57] ABSTRACT

A hands-free hair dryer is described which includes (a) a hair dryer body including heating element and fan, (b) an elongated bendable tubing connected at one end to the hair dryer body, and preferably (c) a spring clamp secured to the other end of the tubing. The tubing is capable of being bent to any desired position or angle where it remains until it is re-positioned. The spring clamp can be attached to any desired surface or support such as a counter, door, towel rack, cupboard, etc. The device allows very convenient hands-free use of the dryer for a variety of purposes.

4 Claims, 8 Drawing Sheets

HANDS-FREE HAIR DRYER

CROSS-REFERENCE TO RELATED APPLICATION

This application is based upon, and claims priority from, our abandoned provisional application Ser. Nos. 60/048,359, filed Jun. 2, 1997, and 60/068,429, filed Dec. 22, 1997.

FIELD OF THE INVENTION

This invention relates to hair dryers. More particularly, this invention relates to hair dryers which can be used without the direct use of the user's hands.

BACKGROUND OF THE INVENTION

Portable hair dryers are commercially available and typically include an electrically-resistive heating element, a fan to direct air outwardly through a barrel or duct after passing through or over the heating element, and a handle for the user to grasp to hold and support the hair dryer in any desired position. A basic problem associated with the use of such hair dryers is that one hand must be used at all times to hold and support the device. However, there are times when it would be very advantageous to be able to have both hands free for brushing or moving the hair while warm air is being directed at the hair.

U.S. Pat. No. 5,592,479 (Trimmer) describes a hands-free hair dryer which includes detachable and interchangeable arms and bases for holding a hair dryer. Specially-made bases are required, however, for use with the device.

U.S. Pat. No. 5,386,644 (Lawall et al.) describes a hands-free hair dryer and accessory. The body of the device is mounted on a wall or the edge of a door. An adjustable hose extends outwardly from the body of the device.

There has not heretofore been described a hands-free hair dryer having the features and advantages provided by the present invention.

SUMMARY OF THE PRESENT INVENTION

In accordance with the present invention there is provided a hands-free hair dryer which includes an elongated semi-rigid semi-flexible gooseneck tubing and clamp means for detachably connecting the dryer to any desired support surface (e.g. a towel bar or rack, counter edge, door, chair, cupboard, etc.). The dryer head, including heating element, fan and barrel, may be moved to any desired position for operation (where the dryer head remains until it is moved to another desired position).

The controls for the dryer may be located at the base of the flexible tubing adjacent the clamp member. The electrical power supply cord may extend through the clamp member and the tubing to the dryer body.

The hair dryer of the invention is compact and fully portable. It can be easily folded for travel or storage. It may also be used with a heat flow bonnet, if desired.

In one embodiment the hair dryer is provided as a cordless battery powered unit. A clamp may be included on the lower end of the gooseneck tubing, if desired, or the cordless unit may be used without a clamp.

Use of a hair dryer of this invention reduces hair drying time because the user can use both hands for brushing or fluffing the hair while warm air is blown through it. The features of the hair drying device are also very beneficial to those persons who may be disabled or who otherwise have trouble holding a hair dryer while also brushing their hair.

Another advantage of the present invention is that it enables a person to apply various chemicals (e.g. heat-activated chemicals) to the hair while at the same time brushing or manipulating it.

The hair dryer of the invention is also very handy for use in drying the hair of pets, where it is necessary to hold the pet while also brushing the hair.

Other advantages and features of the hair dryer of the invention will be apparent from the following detailed description.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
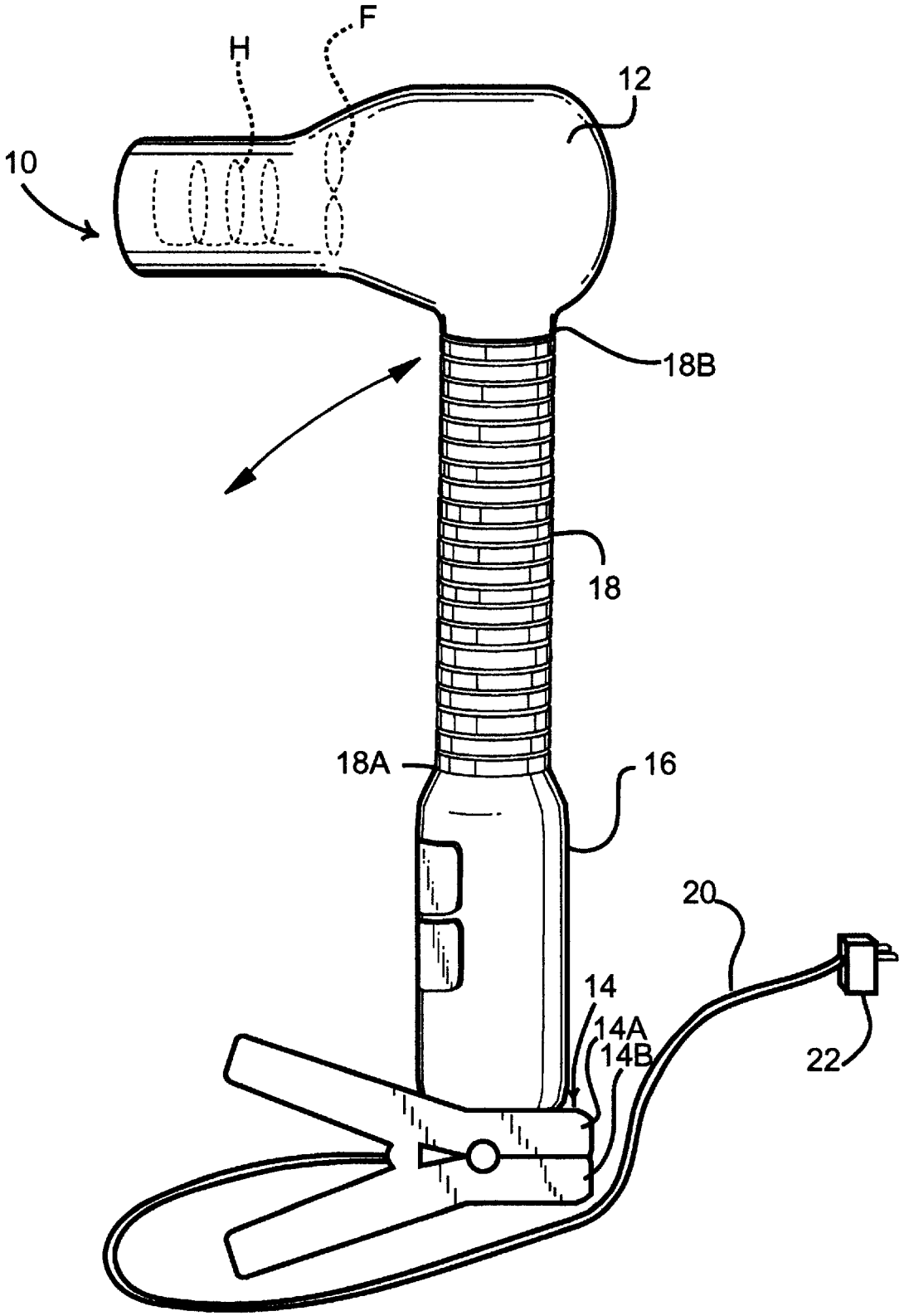
FIG. 1 is a side elevational view of one embodiment of the hair dryer of the invention.

In the drawings there is shown one embodiment of hands-free hair dryer 10 of this invention comprising a hair dryer body 12 (containing a conventional fan F and heating element H for heating air passing through the body). An elongated semi-rigid semi-flexible bendable gooseneck tubing 18 is connected at one of its ends 18B to the hair dryer body and is connected at its opposite end 18A to the hair dryer control module 16.

Secured to the base of the control module 16 is a spring clamp 14 having jaw members 14A and 14B which are pivotably connected and are biased towards each other. A flexible electrical cord 20 extends through an orifice in the base of the clamp, through the control module 16, and then through the tubing 18 to the dryer body. A plug 22 on the free end of the cord enables connection to a source of electrical power (e.g. via a wall socket outlet) If desired, the cord may also include a safety switch or cut-off in the event there is an electrical short in the device.

The jaws of the clamp member can be pivoted to an open position to enable the clamp to be detachably connected or secured to any desired support surface or member (e.g. a counter, door, towel bar or rack, chair, cupboard, etc.). Then the hair dryer can be moved to any desired position or angle by simply bending the tubing 18. The tubing has sufficient resilience to remain in its new position until the user again re-positions it. The hair dryer will operate in any desired position and may also be re-positioned even while it is operating, if desired.

Figure 2:
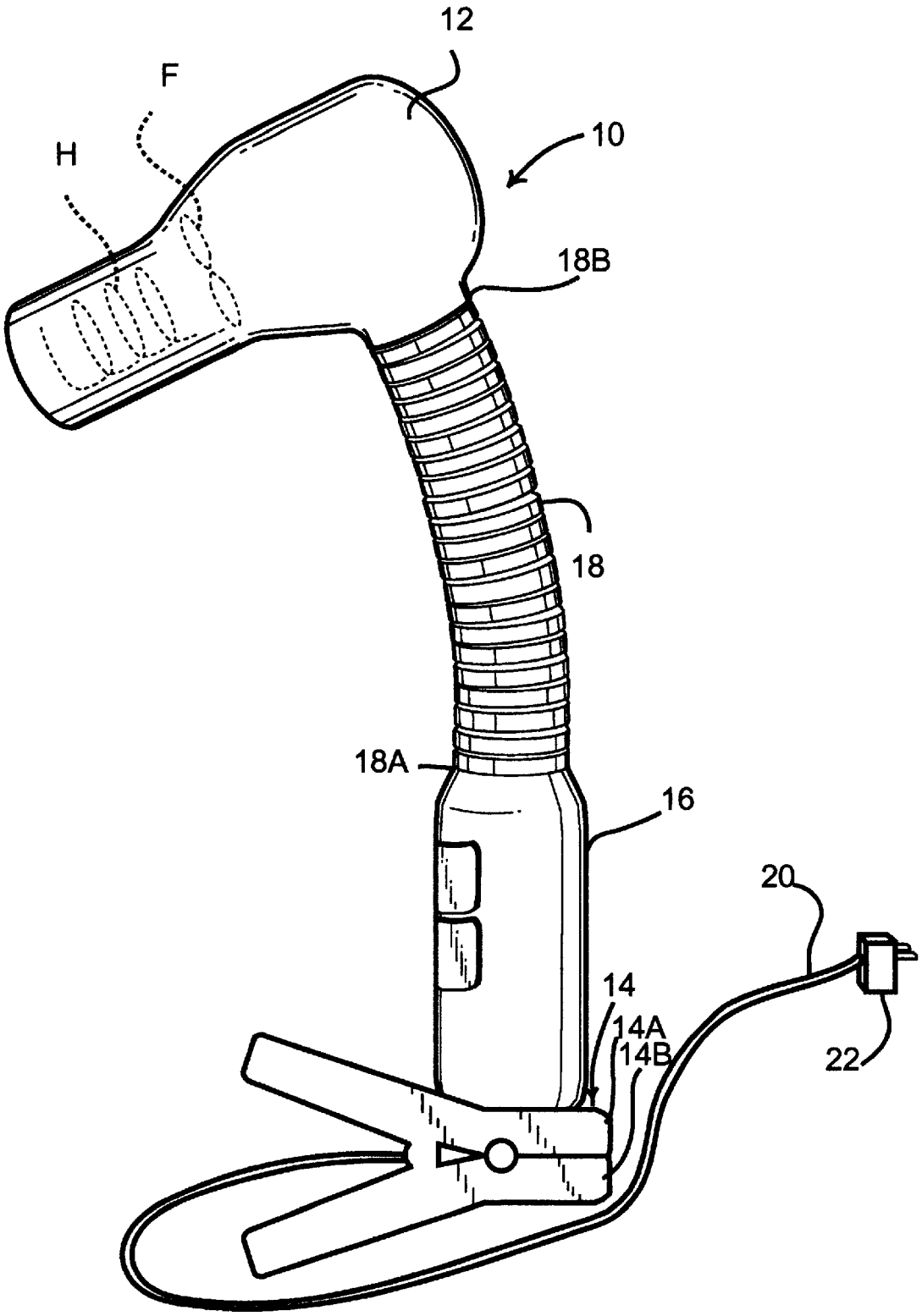
FIG. 2 is a side elevational view of the hair dryer of FIG. 1 in which the dryer body and tubing have been tilted to one side.
Figure 3:
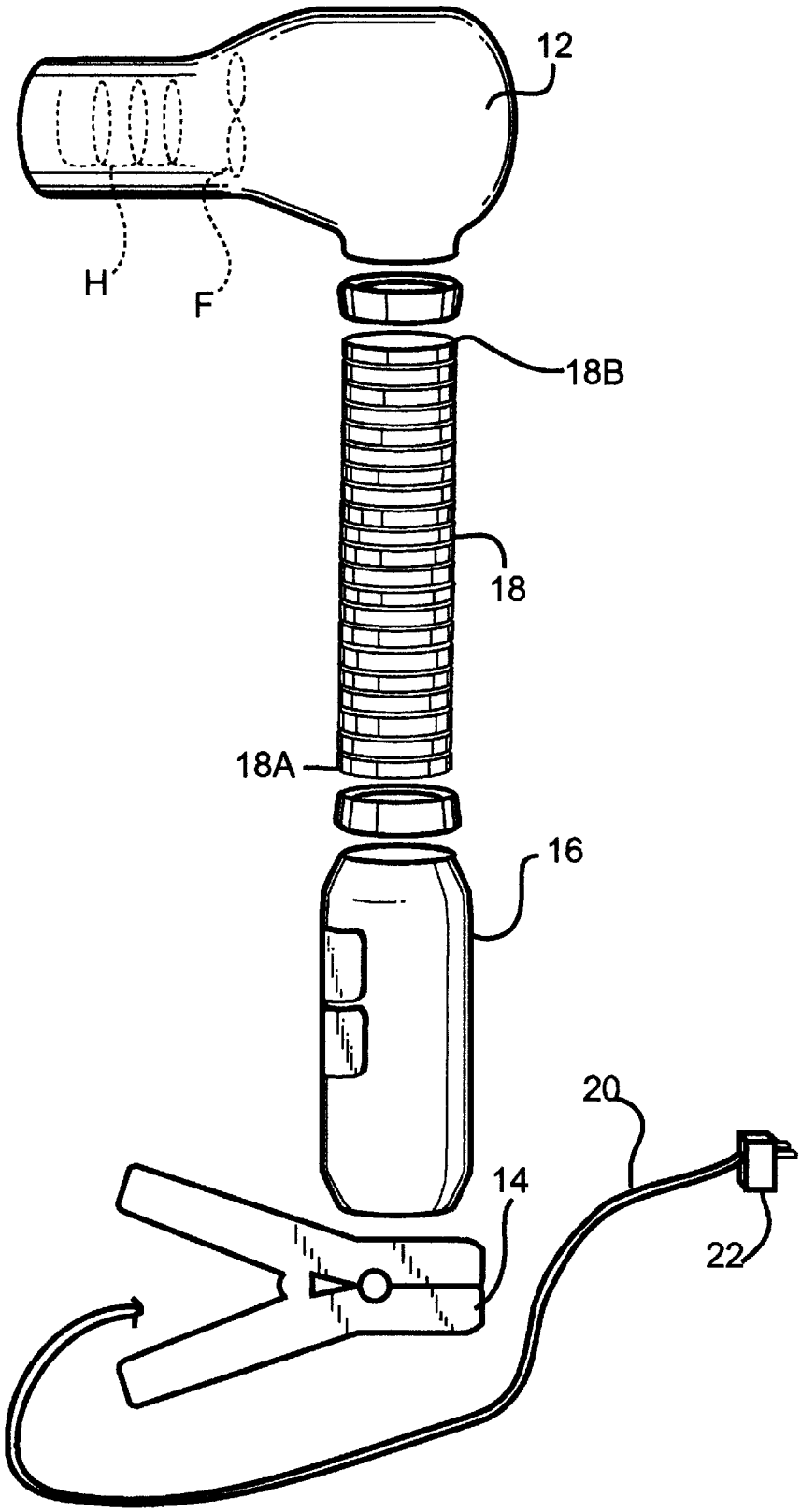
FIG. 3 is an explosion view showing the components of the hair dryer of FIG. 1.
Figure 4:
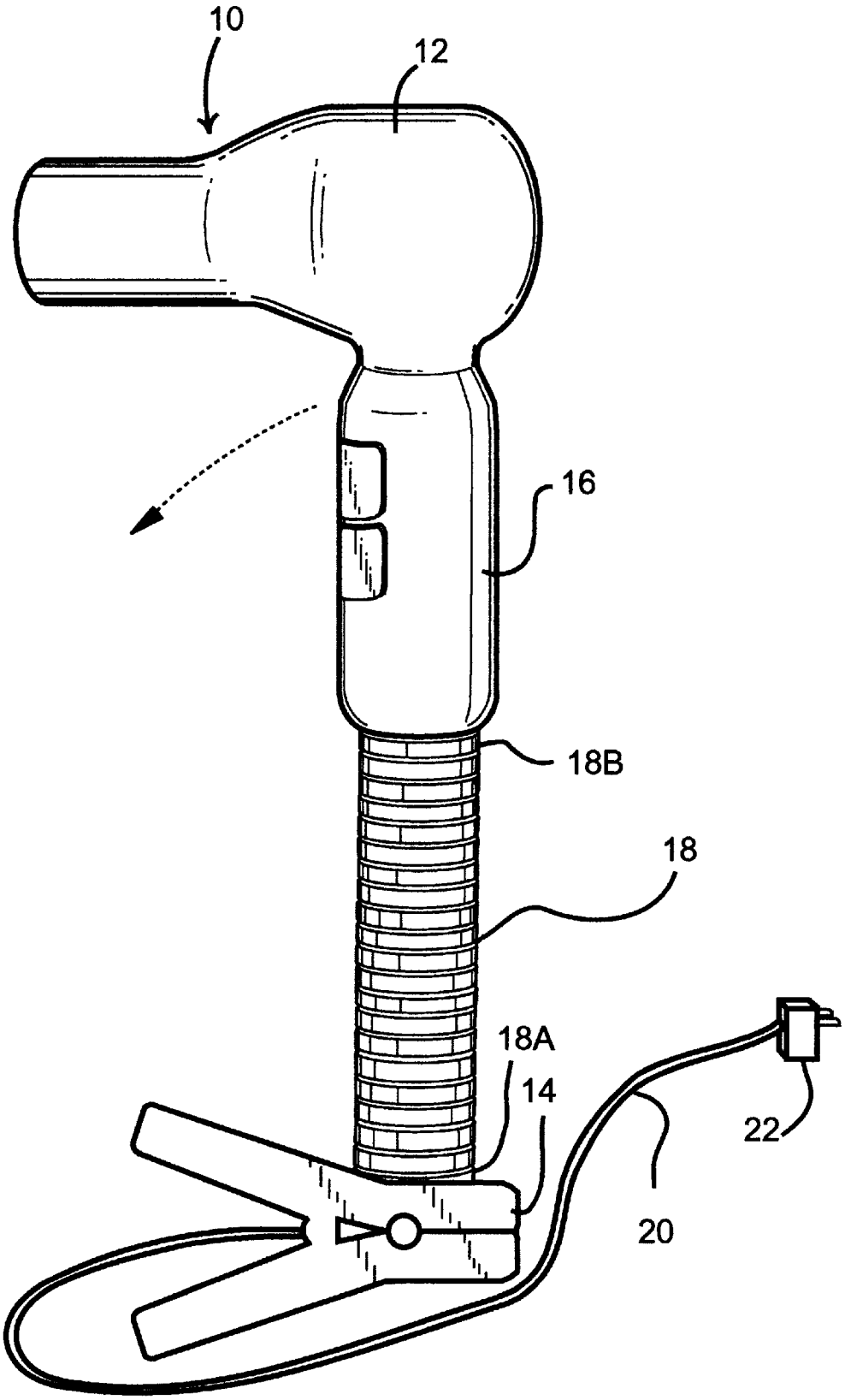
FIG. 4 is a side elevational view of another embodiment of hair dryer of the invention.
Figure 5:
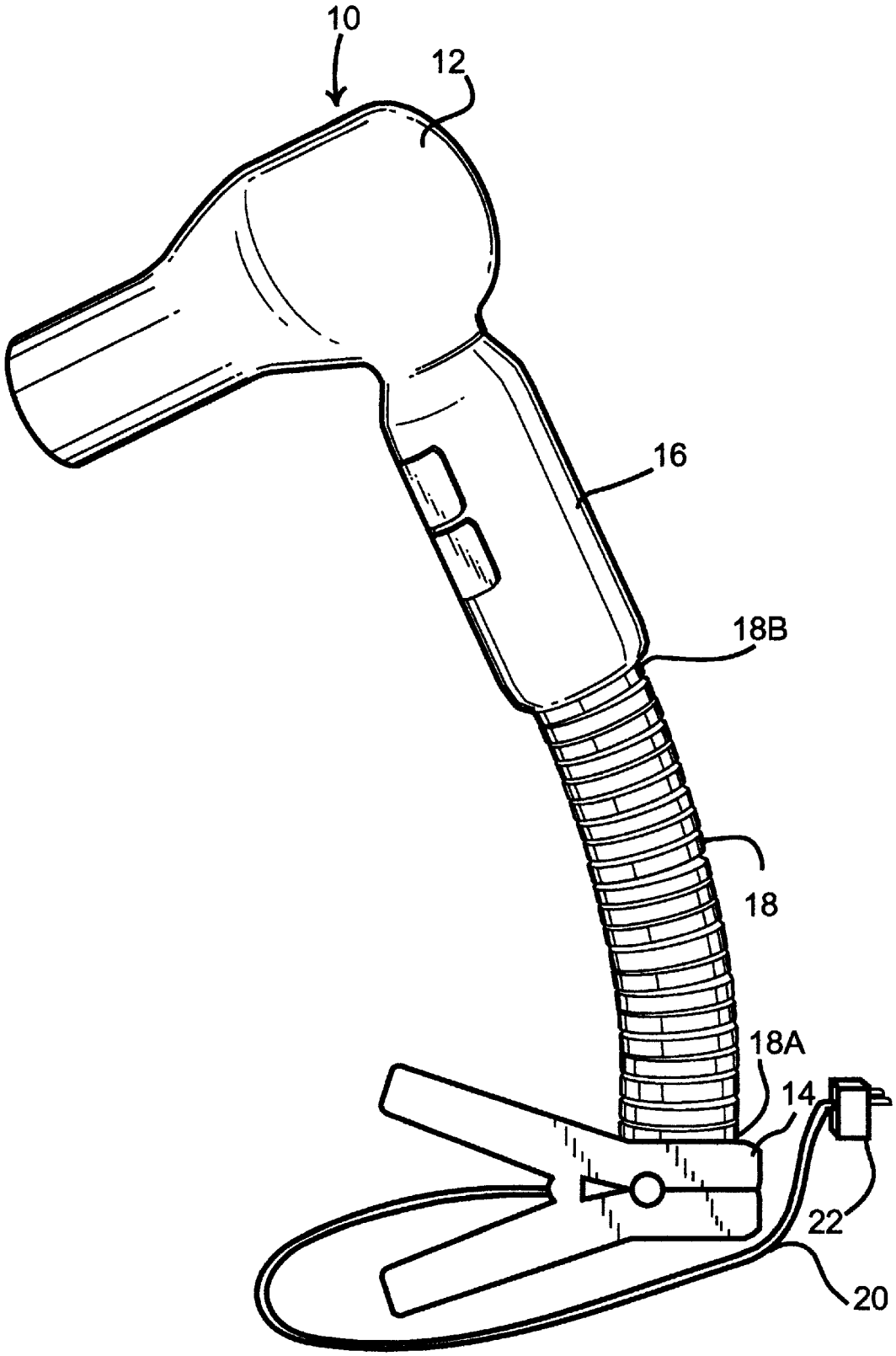
FIG. 5 is a side elevational view of the embodiment of the hair dryer shown in FIG. 4, with the dryer and tubing tilted to one side.

The embodiment of hair dryer shown in FIGS. 4 and 5 is essentially the same as that shown in FIGS. 1–3 except that the control module 16 is connected directly to or included in the base of the hair dryer body 12. The tubing 18 is then connected between the clamp member and the lower end of the control module.

Figure 6:
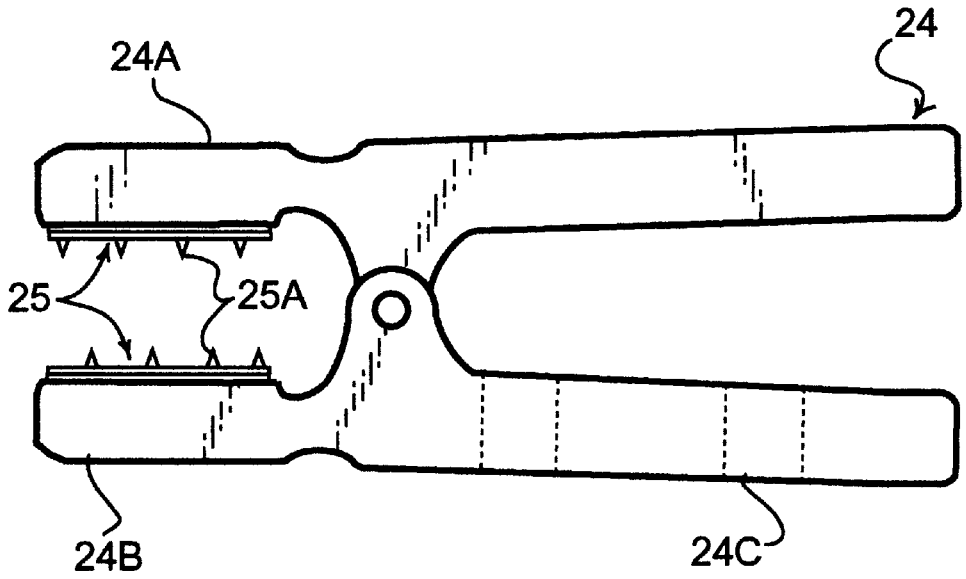
FIGS. 6 and 6A are side elevational and bottom views, respectively, of another embodiment of clamp member which is useful in this invention.
Figure 6A:
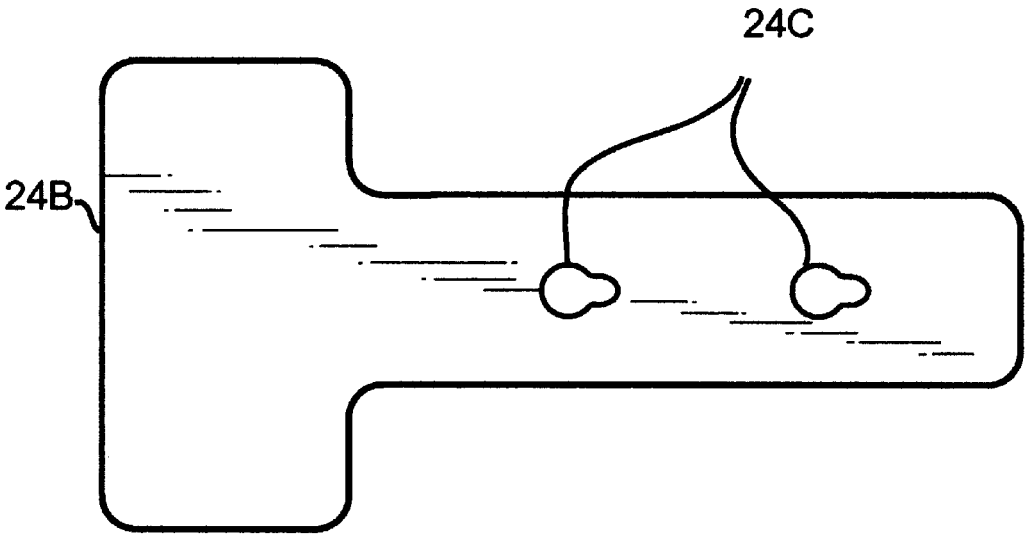

FIGS. 5 and 6 illustrate another type of spring clamp member 24 which is useful in this invention. This clamp member includes pivoting jaw members 24A and 24B. The lower jaw member includes openings 24C which enable the clamp member to be detachably connected to any desired surface by means of screws, for example. The jaw surfaces 25 may be covered with soft rubber or soft plastic teeth 25A to enable the clamp to be effectively and safely used on any surface without damaging or marking it.

The flexible bendable tubing 18 may be composed of plastic, metal, or composite materials. The length may vary from about 6 to 12 inches and it preferably has a diameter of about one inch. It can be bent as much as about 90 degrees in any direction so as to position the hair dryer body where desired.

The spring clamp size may also vary. For example, the length of the clamp may be about 4 to 6 inches. The width of the jaw members may also vary as desired.

The device of this invention is intended for use in any environment where the user requires both hands for other tasks and does not desire to use one hand for holding a hair dryer.

Figure 7:
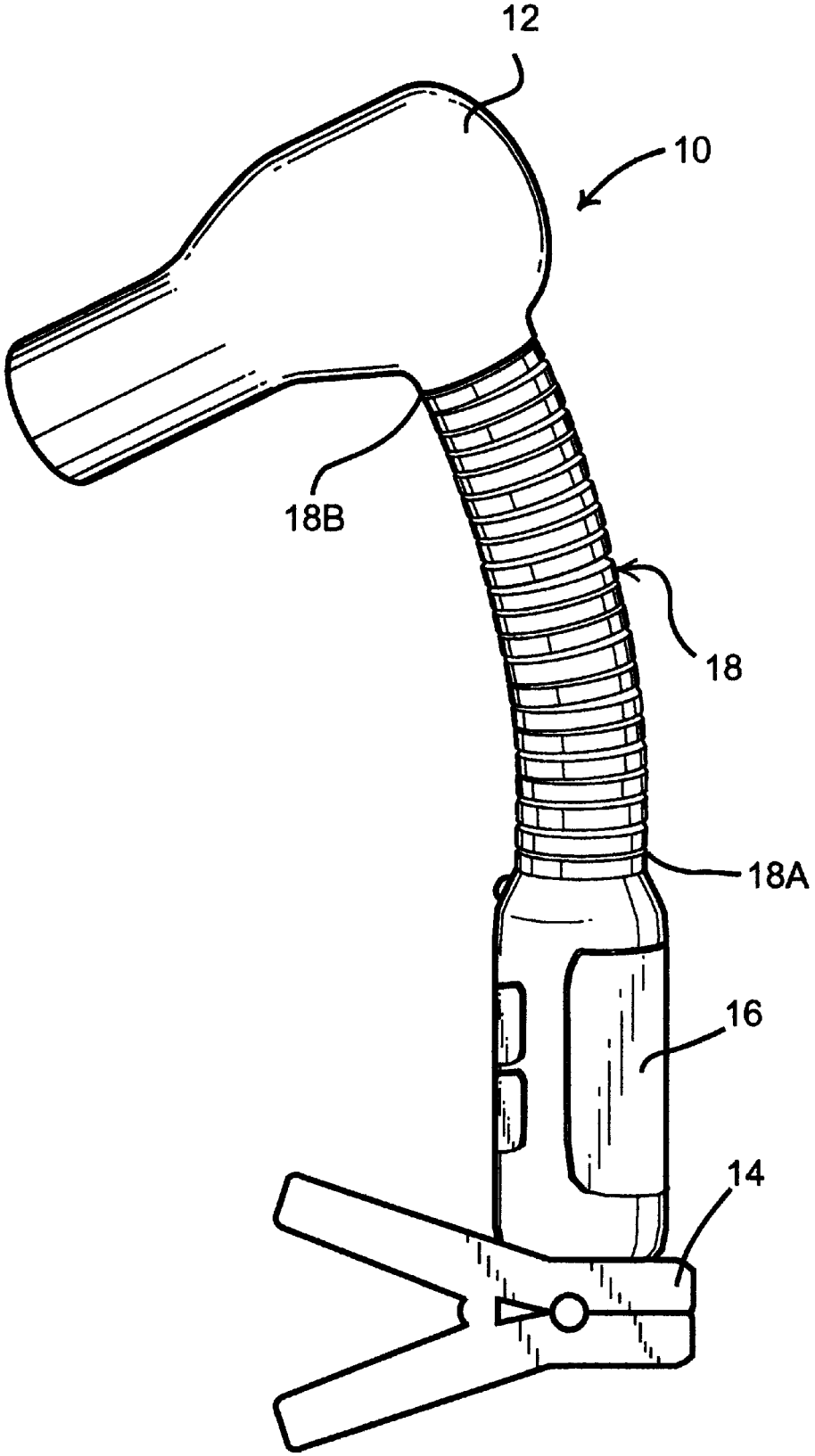
FIGS. 7 and 7A are side elevational views of a cordless hair dryer of the invention.
Figure 7A:
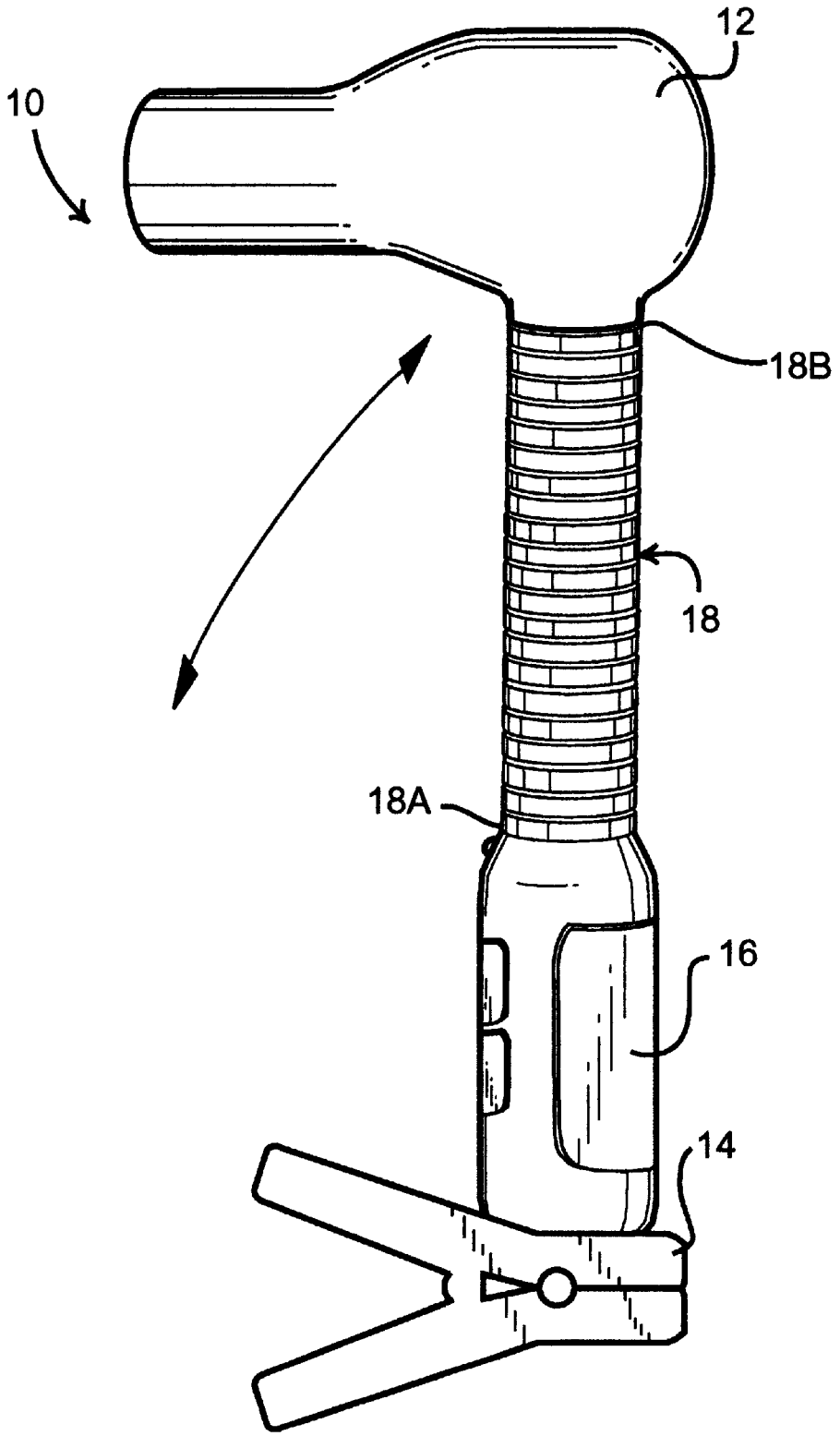

The embodiment of the invention shown in FIGS. 7 and 7A is a cordless, battery powered hair dryer. The hair dryer body is connected and supported on the upper end 18B of semi-flexible tubing 18. A control module 16 is secured to the lower end of the tubing and includes appropriate batteries for powering the unit. A spring clamp 14 may be secured to the lower end of the control module, if desired. It is also possible, however, to use the hair dryer without the clamp 14. The tubing 18 may be folded or bent so that the unit can be supported from a towel rack, door, etc.

Other variants are possible without departing from the scope and spirit of the present invention.

What is claimed is:

1. A hands-free hair dryer comprising:

(a) a hair dryer body including heating element and fan for forcing air past the heating element and out of the body;

(b) an elongated bendable tubing having first and second ends; wherein said first end is secured to said hair dryer body;

(c) spring clamp means secured to said second end of said tubing; wherein said clamp means comprises a pair of opposing jaw members which are pivotably connected wherein said law members are movable between open and closed positions; wherein said jaw members are biased toward said closed position;

wherein said tubing is capable of being bent between said first and second ends so as to move said hair dryer body to a desired position.

2. A hair dryer in accordance with claim 1, wherein said jaw members include surfaces which are covered with soft rubber or soft plastic.

3. A hands-free cordless hair dryer comprising:

(a) a hair dryer body including heating element and fan for forcing air past the heating element and out of the body;

(b) an elongated bendable tubing having first and second ends; wherein said first end is secured to said hair dryer body;

wherein said tubing is capable of being bent between said first and second ends so as to move said hair dryer body to a desired position.

4. A hair dryer in accordance with claim 3, further comprising a spring clamp means secured to said second end of said tubing; wherein said clamp means comprises a pair of opposing jaw members which are pivotably connected; wherein said jaw members are movable between open and closed positions; wherein said jaw members are biased toward said closed position.

* * * * *